US006540200B2

(12) United States Patent
Afolabi

(10) Patent No.: US 6,540,200 B2
(45) Date of Patent: Apr. 1, 2003

(54) FREEZER TRAY UNIT

(76) Inventor: Oluwafemi Ajibola Afolabi, 16 Horsham Street, Brampton, Ontario (CA), L6X 3R4

( * ) Notice: Subject to any disclaimer, the term of this patent is extended or adjusted under 35 U.S.C. 154(b) by 0 days.

(21) Appl. No.: 09/866,627

(22) Filed: May 30, 2001

(65) Prior Publication Data

US 2002/0179809 A1 Dec. 5, 2002

(51) Int. Cl.[7] ..... F25C 1/24

(52) U.S. Cl. ..... 249/66.1; 249/67; 249/118; 249/119; 249/120

(58) Field of Search ..... 249/119, 120, 249/66.1, 118, 67, 68

(56) References Cited

U.S. PATENT DOCUMENTS 1,948,147 A * 2/1934 Warren ..... 249/119
2,043,846 A * 6/1936 Wise ..... 249/119
2,159,338 A * 5/1939 Murphy ..... 249/119
2,181,114 A * 11/1939 Berg ..... 249/119
2,247,019 A * 6/1941 Henning ..... 249/119
2,248,651 A * 7/1941 Von Losberg ..... 249/119
4,635,817 A * 1/1987 Kostov ..... 249/119
4,986,432 A * 1/1991 Anghileri ..... 249/119

* cited by examiner

*Primary Examiner*—James P. Mackey

(57) ABSTRACT

A freezer tray unit that houses removable inserts with various cavity shapes. This unit can be used to make ice in an unlimited number of shapes, by simply changing the inserts. This unit is made up of several kit contents. The quantities required for one kit are the body (1), slotted rod (1), bottom tray (1), releasers (8), and inserts (8). The unit utilizes two mechanisms for ice removal. One mechanism removes ice from individual inserts. Features responsible for this mechanism are the insert guard, slotted rod, releaser, and bottom tray. Another mechanism removes ice from all the inserts simultaneously. The ice removal features utilized in this mechanism are the insert guard, ice guard, slotted rod, and releaser. The inserts can be utilized independently in refrigerators for effective space management. Also, the inserts may be utilized for making baked products in ovens.

8 Claims, 6 Drawing Sheets

FREEZER TRAY UNIT

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to ice (or gelatin dessert product, e.g. Jell-O™) making devices used inside freezers, more specifically, ice trays. Existing ice trays and other ice making devices in freezers have permanently-attached cavities that produce ice with a single shape. Therefore, the end user is unable to determine the shape of the resulting ice that forms.

The methods used to remove ice in most freezer trays are complicated. Some methods involve twisting, or temporarily altering the shape of the ice tray. Other methods involve the application of forces on one or more sides of the ice container, and utilizing kitchenware.

Another limitation of existing ice making devices involves freezer space shortage. The fixed size and shape is difficult to fit inside fully packed or small freezer designs.

BRIEF SUMMARY OF THE INVENTION

This invention allows the end user to make ice pieces with one or more shapes by utilizing inserts with various pre-shaped cavities.

The invention employs two simple ice release and removal mechanisms. The individual ice pieces are removable as pairs, or in their entirety from the freezer tray unit.

Each ice-forming insert can be used individually, without the remaining kit components. This helps to effectively manage freezer space, when desired.

Inserts fabricated from high temperature resistant material are multi-functional. These inserts can be used to freeze and bake items.

BRIEF DESCRIPTION OF THE SEVERAL VIEWS OF THE DRAWING

All the components that comprise the freezer tray kit invention have been illustrated in the accompanying drawings.

Figure 1:
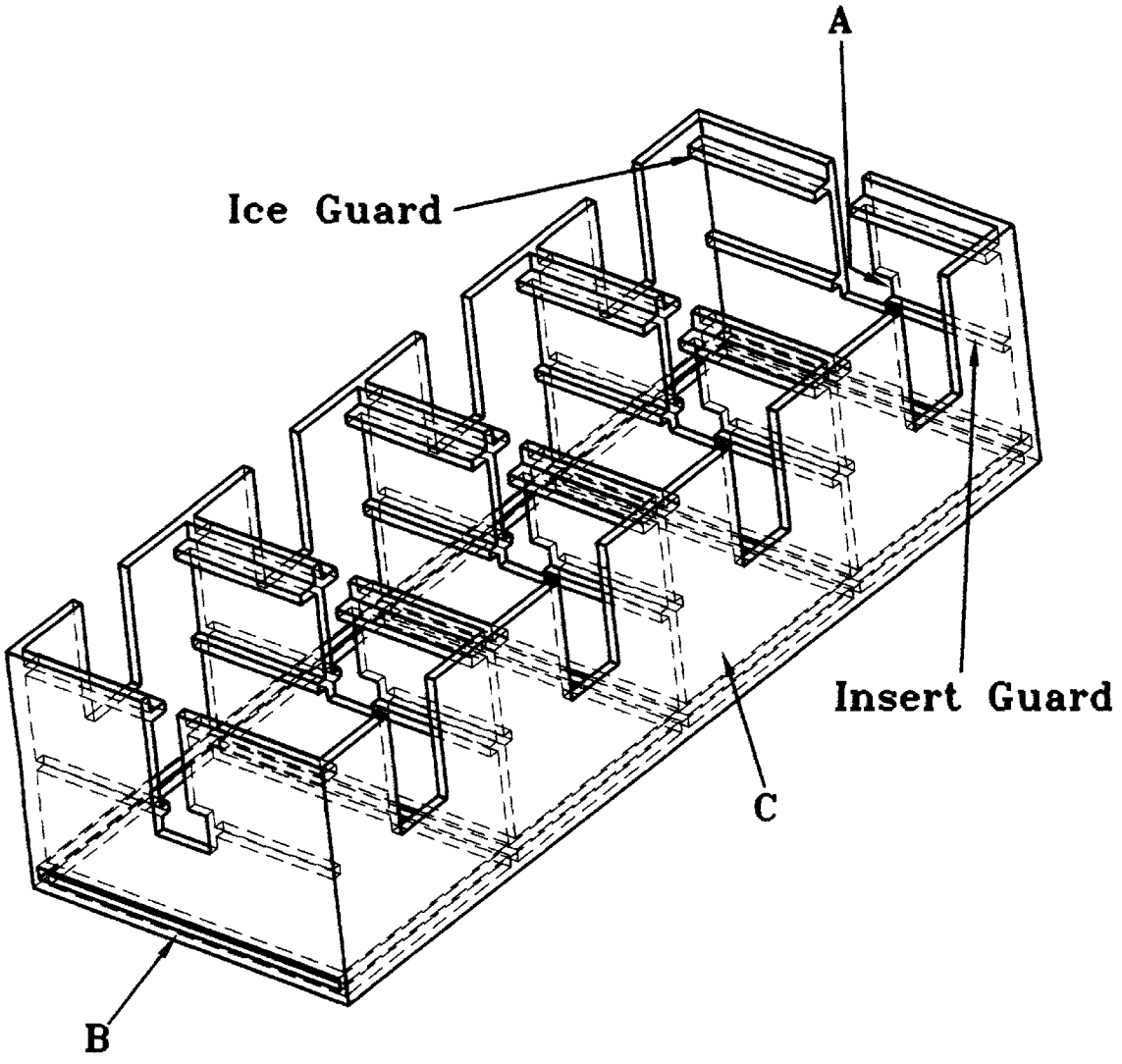
FIG. 1 is a perspective view of the Body. Arrow A depicts the direction in which the slotted rod is attached to the body. Arrow B shows the slot and direction for attaching the bottom tray. Arrow C depicts the compartment for inserts.

The quantities required for one kit are the body (1), slotted rod (1), bottom tray (1), releasers (8), and inserts (8).

DETAILED DESCRIPTION OF THE INVENTION

The first kit assembly step occurs in an inverted position of the body. Inserts are arranged into compartments as depicted by C in FIG. 1. Thereafter, the bottom tray slides in place, as shown in FIG. 1, depicted by B. The bottom tray supports the inserts in the upright position.

Figure 2:
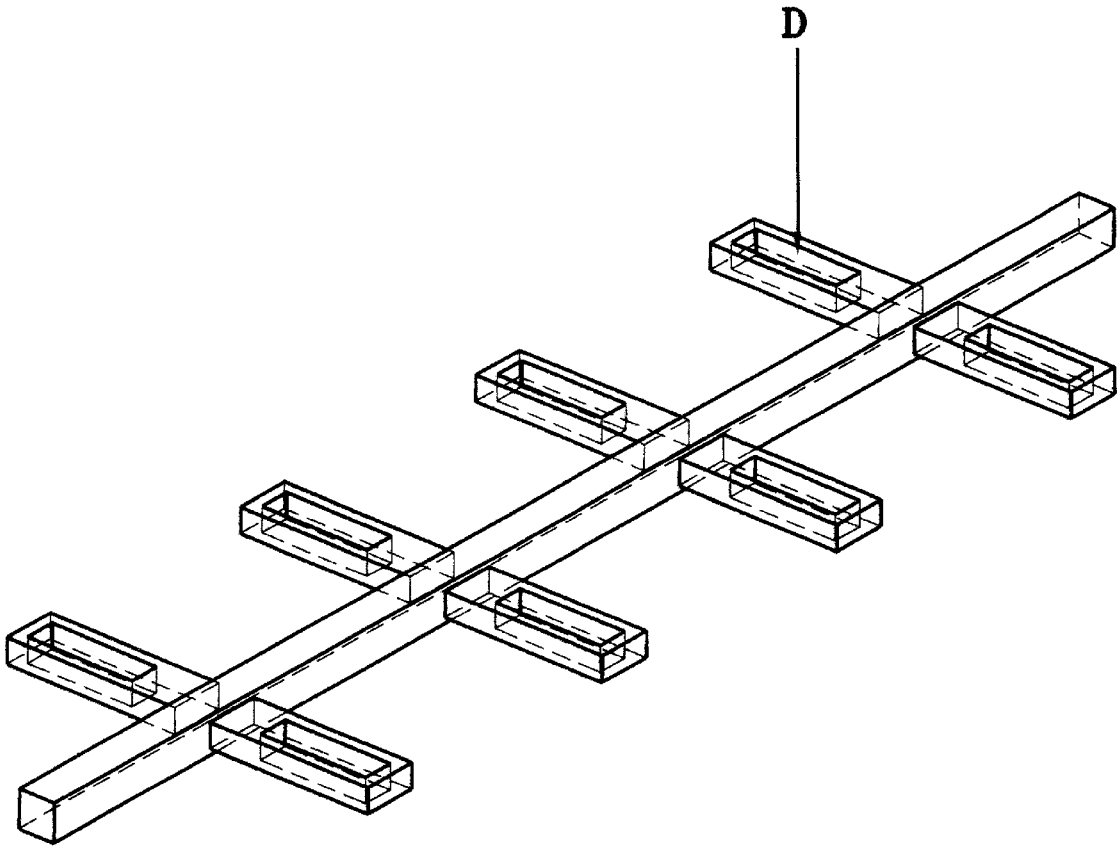
FIG. 2 shows a perspective view of the Slotted Rod. Arrow D depicts a slot and direction of inserting the releasers, bottom end first.
Figure 3:
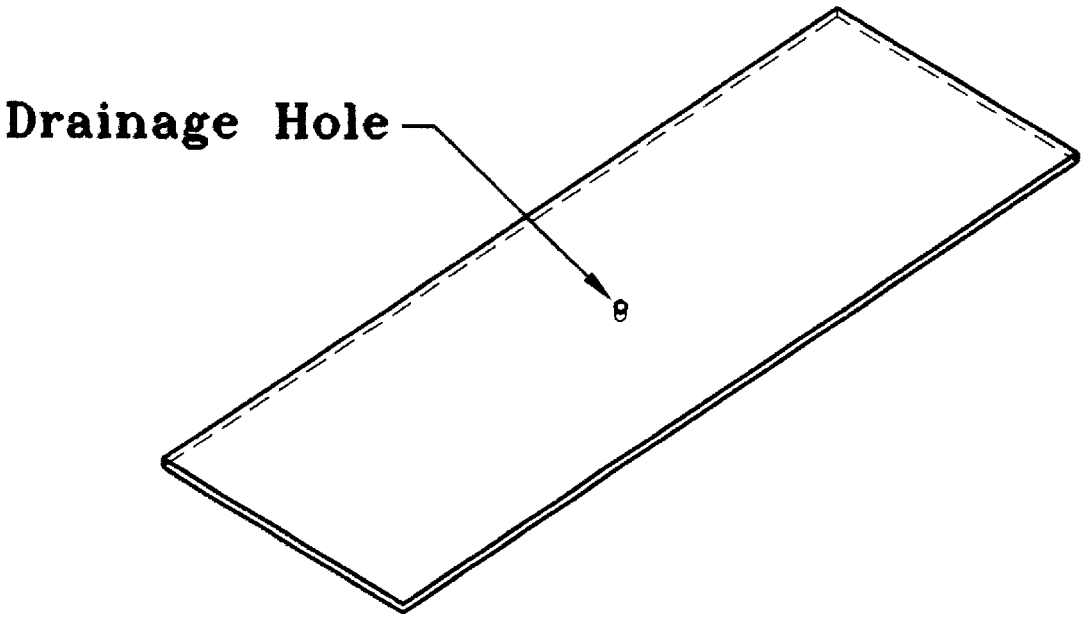
FIG. 3 depicts a perspective view of the Bottom Tray.
Figure 4:
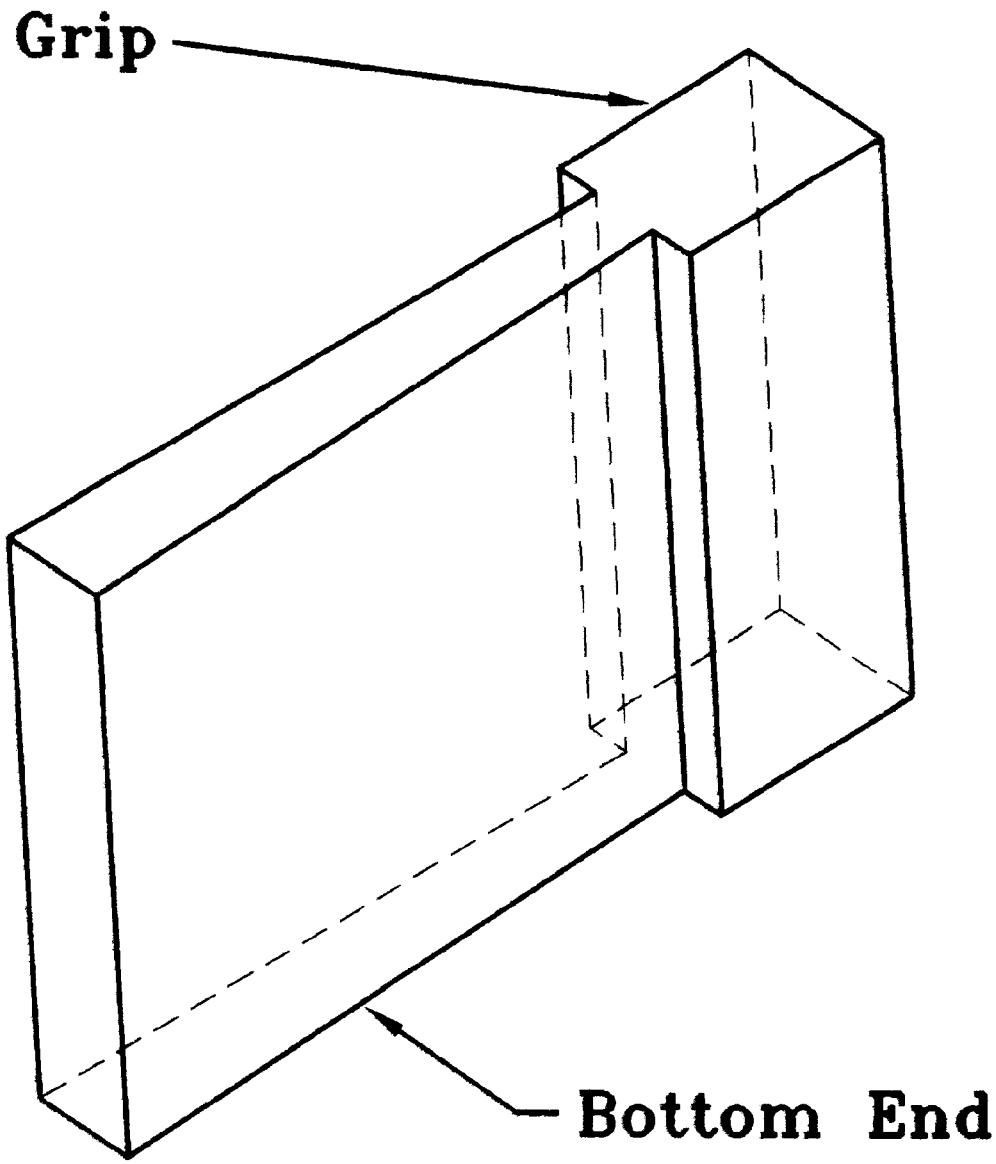
FIG. 4 is a perspective view of the Releaser.
Figure 5:
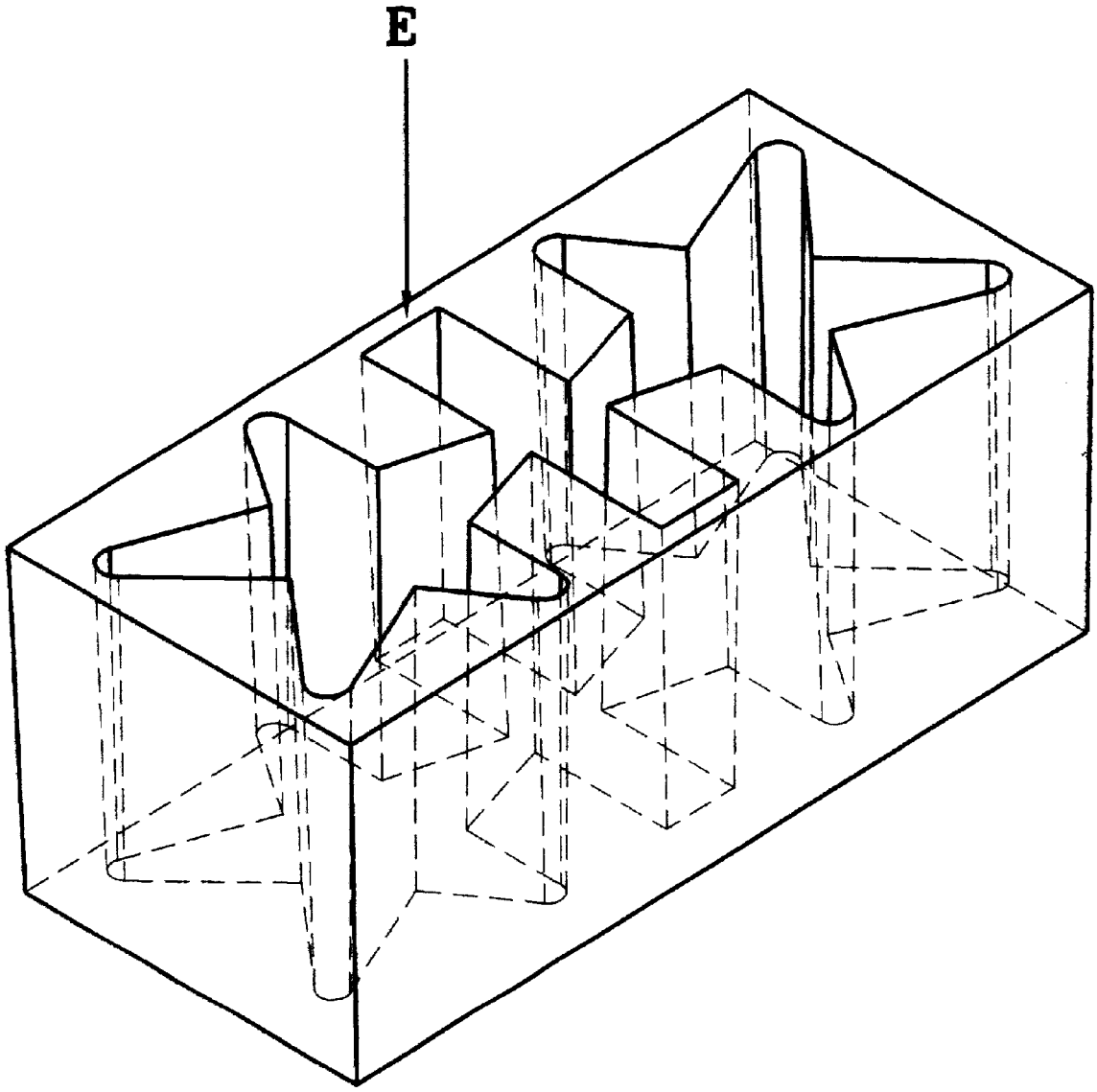
FIG. 5 and FIG. 6 illustrate perspective views of inserts with different cavity shapes. Arrows E and F show the slots into which the releasers are inserted, bottom end first.
Figure 6:
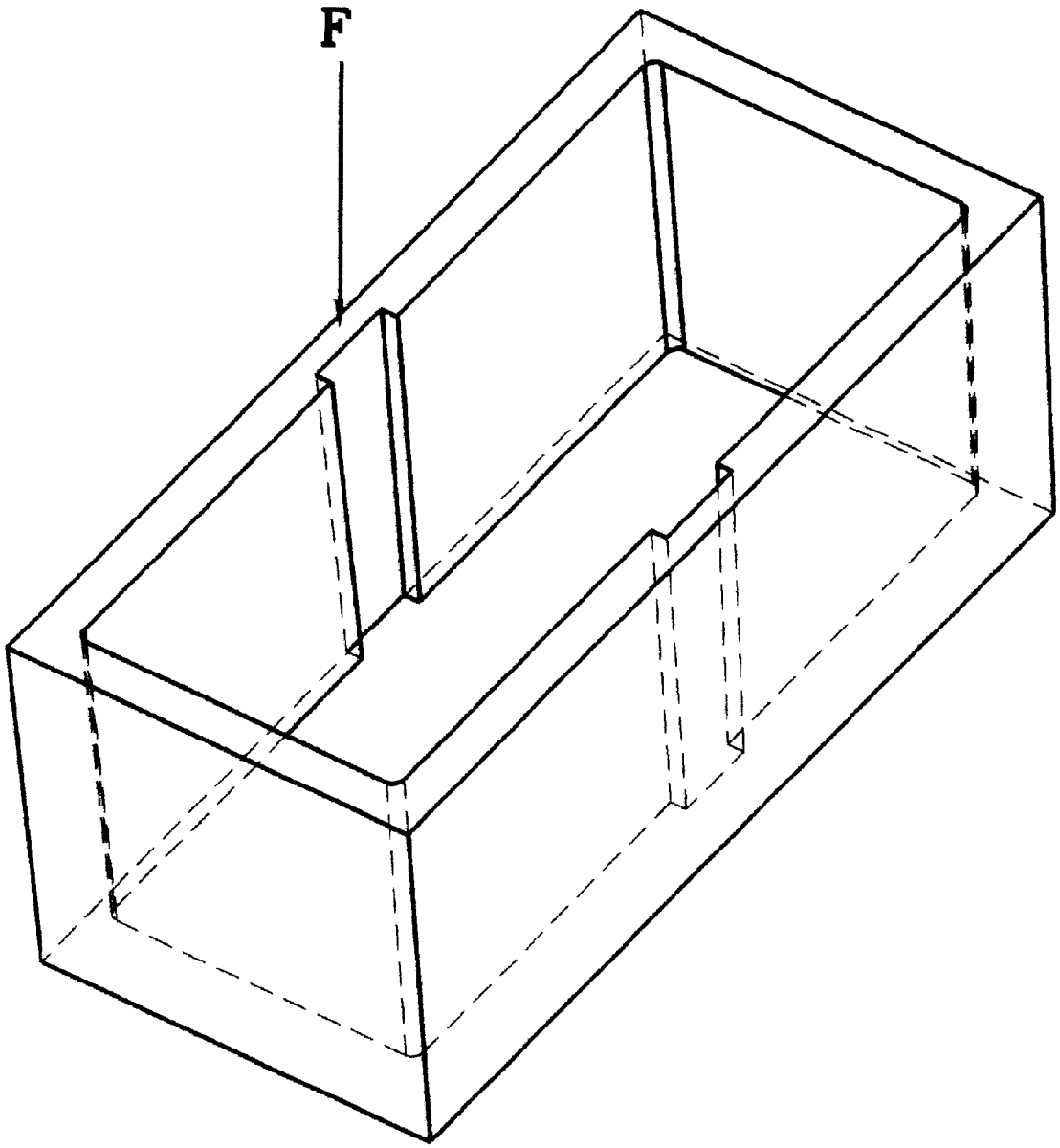

In the next step, the slotted rod is attached to the body as indicated by A in FIG. 1. Then, releasers are inserted into corresponding slots, as depicted in FIG. 2 by D, and also FIG. 5 and FIG. 6 by E and F. The releasers' grips cannot pass through the slots of the slotted rod. As a result, the grip end of each releaser sits on the slotted rod. This is the final step of the kit assembly process.

The liquid to be frozen (water or liquefied form of gelatin dessert product, e.g. Jell-O™) fills the insert cavities from an upright position. The kit is then placed into a freezer to make the ice.

The frozen ice can be removed from each insert in pairs, or from all the inserts simultaneously. The mechanism of releasing ice from individual inserts (as a pair) involves pulling the corresponding grip of the releaser away from the insert. In the second mechanism that releases all the ice simultaneously, the slotted rod is moved in the reverse A direction. Each mechanism releases the ice bonding with the insert and the releasers.

The ice can be removed by inverting or tilting the body (if the slotted rod has been previously detached as in the second mechanism), or by sliding the bottom tray in the B direction to remove single inserts and loosened ice from compartments.

In the first ice release mechanism, the insert guard prevents the insert from advancing further, while the releaser is being displaced or pulled away. The vertical slant or draft of the releaser helps to maintain upward pressure on the ice. This results in the removal of the ice from the insert cavities, while further displacement of the insert is prevented. Any sustained bonding with the releaser is eliminated when the ice makes contact with the slotted rod, as the releaser gets advanced further.

In the second mechanism, ice is released from all inserts in a similar fashion as the first mechanism, when the slotted rod is displaced or pulled away. The function of the ice guard is to detach ice pieces from the releaser at this point.

Insert and releaser combinations can be utilized individually to effectively manage freezer space. In this case, the releaser is inserted into the insert slots depicted by E and F in FIGS. 5 and 6. Thereafter, the insert cavity is filled with liquid and placed in a freezer. The frozen ice is released by keeping the insert stationary (holding down), while displacing or pulling the releaser upwards.

I claim:

1. A freezer tray unit for producing ice or gelatin dessert product comprising:

an insert for containing the ice or gelatin dessert product, the insert defining an open end, and a cavity in fluid connection with the open end, the cavity having a wall, the wall defining an insert slot extending from the open end;

a body comprising a compartment adapted to receive the insert, the compartment having an open compartment end;

a removable releaser adapted to be partially received in the insert slot, comprising a section for extending into the insert slot through the open end and a grip external to the insert slot for applying a pressure to remove the section from the insert slot when the releaser is partially received; and an insert guard connected to the open compartment end for restraining the insert from removal from the compartment when the pressure is applied to the grip to remove the section extending into the insert slot.

2. The freezer tray unit of claim 1, wherein the section of the releaser has a surface tapering with increased extension into the insert slot towards the cavity for engaging the ice or gelatin dessert product when the releaser is partially received.

3. The freezer tray unit of claim 2, wherein;

the insert guard is a flange.

4. The freezer tray unit of claim 3, further comprising:

a slotted rod, the slotted rod defining a rod slot adapted to partially receive and suspend the releaser in the rod slot when the section extends into the insert slot; and wherein the slotted rod displaces the grip in a direction away from the insert slot when a rod pressure is applied to the slotted rod to extract the section from the insert slot.

5. The freezer tray unit of claim 4, wherein the slotted rod further comprises an element, wherein the element occludes in part or in whole the path of the ice or gelatin dessert product when the rod pressure is applied to the slotted rod to extract the section extending into the insert slot.

6. The freezer tray unit of claim 5, further comprising:

an ice guard attached to the body for occluding the path of the ice or gelatin dessert product in the cavity when the section is extracted from the insert slot.

7. The freezer tray unit of claim 6, wherein:

the body defines a closeable opening through which the insert may be removed; and the opening may be made closeable by means of a tray slideable in a track connected to the body.

8. The freezer tray unit of claim 7, further comprising:

a plurality of said inserts;

a plurality of said compartments, each of said compartments receiving at least one said insert;

a plurality of said releasers, each releaser for reception in an insert slot of said inserts;

a plurality of said insert guards, each said insert guard connected to one of said compartments; and a plurality of said ice guards;

wherein the slotted rod defines a plurality of rod slots, each rod slot adapted to partially receive and suspend one of said releasers in the rod slot when the section of the one of said releasers extends into the corresponding insert slot; and the slotted rod displaces the grip of each said releasers in a direction away from the insert slots when the rod pressure is applied to the slotted rod to extract the sections of the said releaser from the insert slots.

* * * * *